US006381753B1

(12) United States Patent
Smith et al.

(10) Patent No.: US 6,381,753 B1
(45) Date of Patent: May 7, 2002

(54) PROTECTIVE GLOVE

(75) Inventors: Curtis R. Smith, Wellesley; James P. Lattari, Attleboro, both of MA (US)

(73) Assignee: Whiting and Davis, Inc., Attleboro ( * ) Notice: Subject to any disclaimer, the term of this patent is extended or adjusted under 35 U.S.C. 154(b) by 0 days.

(21) Appl. No.: 09/427,874

(22) Filed: Oct. 27, 1999

(51) Int. Cl.[7] ..... A41D 19/00

(52) U.S. Cl. ..... 2/167; 2/156; 2/161.6; 2/163; 2/164

(58) Field of Search ..... 2/159, 161.6, 163, 2/164, 166, 169, 167, 174

(56) References Cited

U.S. PATENT DOCUMENTS

| | | | | |
|---|---|---|---|---|
| 183,375 | A | | 10/1876 | Cutliff |
| 218,322 | A | | 8/1879 | Schilling |
| 436,206 | A | | 9/1890 | Bertheau et al. |
| 470,170 | A | * | 3/1892 | Alderman |
| 629,901 | A | * | 8/1899 | Greenstreet |
| 676,210 | A | * | 6/1901 | Torley |
| 750,903 | A | * | 2/1904 | Shrum et al. |
| 752,769 | A | | 2/1904 | Graichen |
| 1,010,199 | A | | 11/1911 | Stedman |
| 1,106,708 | A | | 8/1914 | Hazard |
| 1,250,150 | A | * | 12/1917 | DuBois |
| 1,270,697 | A | * | 6/1918 | Chapman |
| 1,371,841 | A | * | 3/1921 | Berkwits |
| 1,445,094 | A | * | 2/1923 | Lindfeldt |
| 1,498,489 | A | * | 6/1924 | Steinmetz |
| 1,612,757 | A | * | 12/1926 | Wells |
| 1,736,928 | A | | 11/1929 | Lowe |
| 2,067,424 | A | | 1/1937 | Steinberger |
| 2,344,080 | A | * | 3/1944 | Burgett |
| 2,452,286 | A | | 10/1948 | Benjamin |
| 2,501,571 | A | | 3/1950 | Liedtke |
| 2,521,144 | A | | 9/1950 | Bergh |
| 2,540,234 | A | | 2/1951 | Berger et al. |
| 2,831,196 | A | | 4/1958 | Scheiber |
| 2,862,208 | A | | 12/1958 | Castro |
| 2,864,091 | A | | 12/1958 | Schneider |
| 2,895,139 | A | | 7/1959 | Compton |
| 3,296,628 | A | | 1/1967 | Collins |
| 3,577,836 | A | | 5/1971 | Tamura |
| 3,872,514 | A | | 3/1975 | Liebelt |
| 3,883,898 | A | | 5/1975 | Byrnes, Sr. |
| 3,885,383 | A | | 5/1975 | Tanaka |
| 3,916,448 | A | | 11/1975 | Hamel |
| 3,953,893 | A | | 5/1976 | Byrnes, Sr. |
| 4,004,295 | A | | 1/1977 | Byrnes, Sr. |
| 4,021,891 | A | | 5/1977 | Morita |
| 4,149,296 | A | | 4/1979 | Stanford |
| 4,200,852 | A | | 4/1980 | Aoki |
| 4,229,496 | A | | 10/1980 | Striegel |
| 4,388,733 | A | | 6/1983 | Anstett |
| 4,438,532 | A | | 3/1984 | Campanella et al. |
| 4,453,294 | A | | 6/1984 | Morita |
| 4,471,495 | A | | 9/1984 | Kruse et al. |
| 4,493,865 | A | | 1/1985 | Kuhlmann et al. |

(List continued on next page.)

FOREIGN PATENT DOCUMENTS

| | | | |
|---|---|---|---|
| DE | 2818021 | C2 | 1/1980 |
| DE | 3305841 | a1 | 8/1984 |
| DE | 3238499 | C2 * | 1/1990 |

(List continued on next page.)

OTHER PUBLICATIONS

Vest/Arm Protector, Jul. 22, 1989, National Provisioner.*

*Primary Examiner*—John J. Calvert
*Assistant Examiner*—Robert H. Muromoto, Jr.
(74) *Attorney, Agent, or Firm*—Iandiorio & Teska

(57) ABSTRACT

A protective glove with a plurality of fingers made of metal mesh material, adjacent fingers defining a crotch region therebetween and a plurality of web members each disposed across a crotch region joining adjacent fingers together providing a U-shaped cradle for improved comfort, stress relief, and wear.

16 Claims, 4 Drawing Sheets

U.S. PATENT DOCUMENTS

| | | | | | |
|---|---|---|---|---|---|
| 4,507,353 | A | | 3/1985 | Kuhlmann et al. | |
| 4,525,877 | A | * | 7/1985 | Chong | 2/161.1 |
| 4,700,436 | A | | 10/1987 | Morita | |
| 4,709,694 | A | * | 12/1987 | O'Connell | 602/21 |
| 4,723,406 | A | | 2/1988 | Ripley | |
| 4,750,218 | A | | 6/1988 | Ziegler | |
| 4,802,242 | A | | 2/1989 | Lars-Jos | |
| 4,841,577 | A | | 6/1989 | Lars-Jos | |
| 4,843,650 | A | | 7/1989 | Kangas et al. | |
| 4,868,927 | A | | 9/1989 | Bourdeau et al. | |
| 5,023,953 | A | | 6/1991 | Bettcher | |
| 5,035,001 | A | | 7/1991 | Novick | |
| 5,054,126 | A | | 10/1991 | Rivkin | |
| 5,070,540 | A | | 12/1991 | Bettcher et al. | |
| 5,073,441 | A | | 12/1991 | Melec et al. | |
| 5,088,123 | A | | 2/1992 | MacDonald | |
| 5,113,526 | A | | 5/1992 | Wang et al. | |
| 5,142,746 | A | | 9/1992 | Morita | |
| 5,201,075 | A | | 4/1993 | Svetich | |
| D348,141 | S | | 6/1994 | Lars-Jos, Jr. et al. | |
| 5,323,490 | A | * | 6/1994 | Yarbrough | 2/161.7 |
| 5,367,711 | A | | 11/1994 | Calagui | |
| 5,497,510 | A | | 3/1996 | Knowles et al. | |
| 5,511,241 | A | | 4/1996 | Ziegler | |
| 5,644,797 | A | * | 7/1997 | Daneshvar | 2/161.7 |
| 5,659,899 | A | | 8/1997 | Sorter et al. | |
| 5,704,066 | A | | 1/1998 | Yamamoto | |
| 5,729,831 | A | | 3/1998 | Kuhlmann | |
| 5,771,488 | A | | 6/1998 | Honkala | |
| 5,862,521 | A | | 1/1999 | van Marwijk et al. | |
| 5,894,602 | A | | 4/1999 | Smith et al. | |

FOREIGN PATENT DOCUMENTS

| | | | |
|---|---|---|---|
| DE | G 94 15 816.9 | | 9/1994 |
| DE | 44 16 389 | A1 | 11/1995 |
| EP | 12483 | * | 12/1909 |
| EP | 0 13 5398 | | 3/1985 |
| WO | PCT/EP95/04040 | * | 10/1994 |
| WO | PCT/EP95/01746 | | 5/1995 |

* cited by examiner

PROTECTIVE GLOVE

FIELD OF INVENTION

This invention relates to a protective glove with web members disposed across the crotch region between adjacent fingers for improved comfort, stress relief, and wear.

BACKGROUND OF INVENTION

Metal mesh gloves are used inter alia, to protect a butcher's hands and forearms against knife cuts and the like.

Prior art metal mesh gloves, however, have fingers joined together by a V-shaped crotch region. In contrast, the crotch region between adjacent fingers of the human hand is more of a U-shape.

Therefore, the V-shaped crotch region between adjacent fingers of prior art metal mesh gloves cause discomfort to the wearer especially when the wearer places the shank of a meat hook between his gloved index and middle fingers and uses the meat hook to forcibly retrieve heavy meat sections for butchering. The repeated frictional contact between the metal rings of the mesh glove and the shank of the meat hook also causes wear, reduces the useful life, and can even destroy the V-shaped crotch regions of the metal mesh glove.

When the crotch region between adjacent fingers of an employee's hand becomes irritated, some employees will also cut out the V-shaped crotch region of the protective metal mesh glove resulting in a glove with unacceptable protection which supervisors ordinarily must repair or discard.

Other employees sometimes purposefully choose a protective metal mesh glove with fingers longer than the employee's fingers. The metal mesh of the glove then bunches up at the crotch region providing some additional comfort and stress relief This practice, however, results in an improperly fitted protective glove and glove fingers which sag due to the effects of gravity when the employee's hand is in any position other than vertically up in the air.

Those skilled in the art of metal mesh glove manufacturing and design have attempted to overcome these problems with limited success by eliminating the seam of adjoining metal mesh rings between the adjacent fingers of the glove but still the gloves have a V-shaped crotch region between adjacent fingers which does not conform to the U-shaped cross regions of the human hand.

SUMMARY OF THE INVENTION

It is therefore an object of this invention to provide a protective metal mesh glove that is more comfortable.

It is a further object of this invention to provide such a protective glove which has a U-shaped crotch region rather than a V-shaped crotch region.

It is a further object of this invention to provide such a glove which has an increased wearable life and an increased mean time between failures.

It is a further object of this invention to provide such a protective metal mesh glove which more nearly conforms to the shape of the human hand.

This invention results from the realization that the discomfort, stress points, and the practice of users either wearing a cotton glove and/or removing the V-shaped crotch region associated with prior art metal mesh protective gloves can be eliminated by the incorporation of a metal mesh "cradle" sewn between adjacent fingers of the glove thereby improving the comfort level of the glove, especially when meat hooks are used, since the cradle protects the user's hand from the shank of the meat hook, and thereby also increases the wearable life of the glove and the mean time between failures of metal mesh protective gloves.

This invention features a protective glove comprising a plurality of fingers made of metal mesh material, adjacent fingers defining a crotch region therebetween; and a plurality of web members each disposed across a crotch region joining adjacent fingers together providing a U-shaped cradle for improved comfort, stress relief, and wear.

In the preferred embodiment, the plurality of web members are made of metal mesh material and there are four fingers and three web members, one web member disposed between each pair of fingers. Typically, the web members are diamond shaped and folded over at the crotch region.

This invention also features a method of manufacturing a protective glove, the method comprising forming two half glove sections of metal mesh material, each section including a plurality of finger portions, adjacent fingers defining a crotch region therebetween; securing the two half glove sections together by joining the metal mesh material together at the periphery of the two sections; fabricating metal mesh material web members; and inserting a web member across each crotch region and joining adjacent fingers together by linking each web member to each crotch region between adjacent fingers.

The fabricating step usually includes making a diamond shaped metal mesh material web member and the step of inserting includes folding the diamond shaped metal mesh material web member in half to form a triangle, one side of which extends across a crotch region.

In some embodiments, only one web member disposed across the crotch region joining two adjacent fingers together providing a U-shaped crotch region between the index finger and the middle finger forming a cradle for the shank of a meat hook.

BRIEF DESCRIPTION OF THE DRAWINGS

Other objects, features and advantages will occur to those skilled in the art from the following description of a preferred embodiment and the accompanying drawings, in which:

Prior art metal mesh glove 10, FIG. 1 is made of interlocking metal mesh rings as shown in FIG. 2. In the prior art, the crotch regions 12, 14, and 16, FIG. 1 between adjacent fingers 18, 20, 22 and 24 are V-shaped in contrast to the U-shaped crotch regions between adjacent fingers of the human hand.

Figure 1:
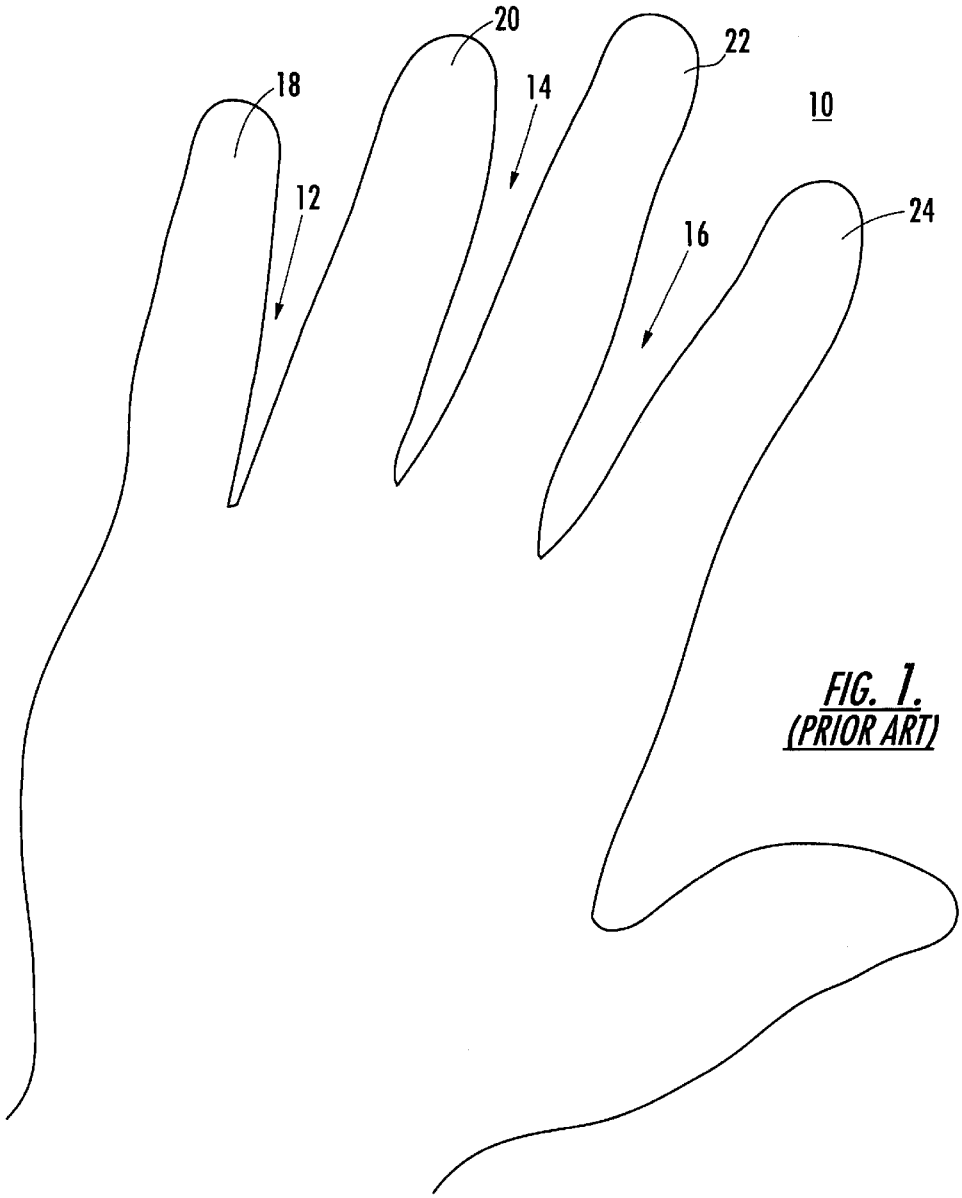
FIG. 1. (PRIOR ART)
FIG. 1 is a view of a prior art metal mesh protective glove with V-shaped crotch regions.
Figure 2:
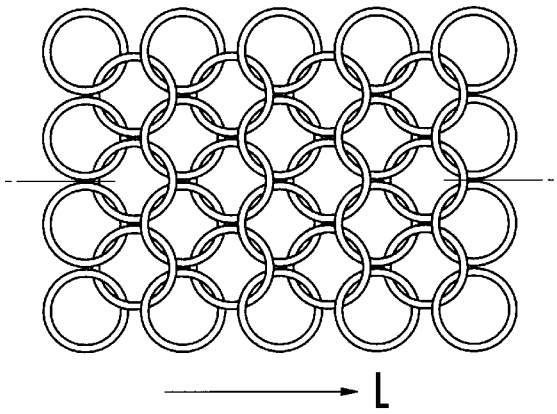
FIG. 2. (PRIOR ART)
FIG. 2 is a top view of one type of metal mesh used in connection with protective gloves in accordance with the prior art and this invention.

As discussed in the Background of the Invention above, V-shaped crotch regions 12, 14, and 16 between adjacent fingers of prior art glove 10, FIG. 1 causes discomfort to the wearer especially when the wearer places the shank of a meat hook between his gloved index 18 and middle 20 fingers and uses the meat hook to forcefully retrieve heavy meat sections for butchering. The repeated frictional contact between the metal rings as shown in FIG. 2 of mesh glove 10, FIG. 1 and the shank of the meat hook also wears or destroys V-shaped crotch region 12, 14, and/or 16 between the fingers of metal mesh glove 10. Some employees, because of the discomfort associated with V-shaped crotch regions 12, 14, and 16, even cut out the crotch regions of protective prior art metal mesh glove 10, FIG. 1. This practice, however, resulted in a glove with unacceptable protection and is also not tolerated in the work place.

Figure 3:
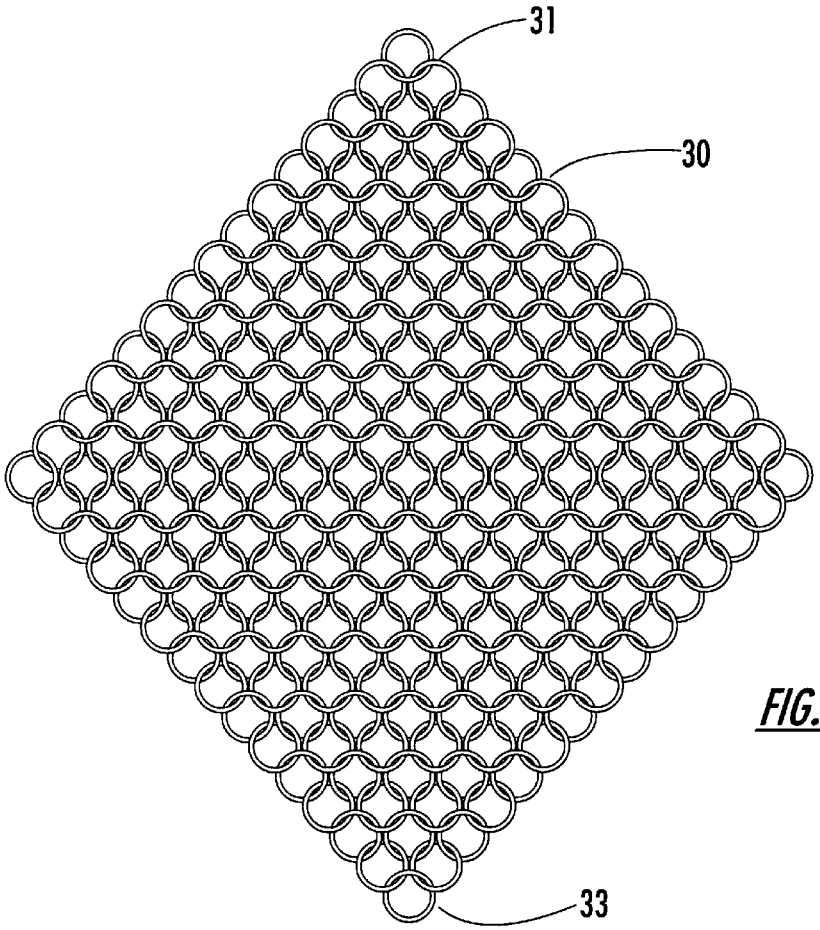
FIG. 3 is a top view of a web member made of metal mesh material in accordance with the subject invention.
Figure 4:
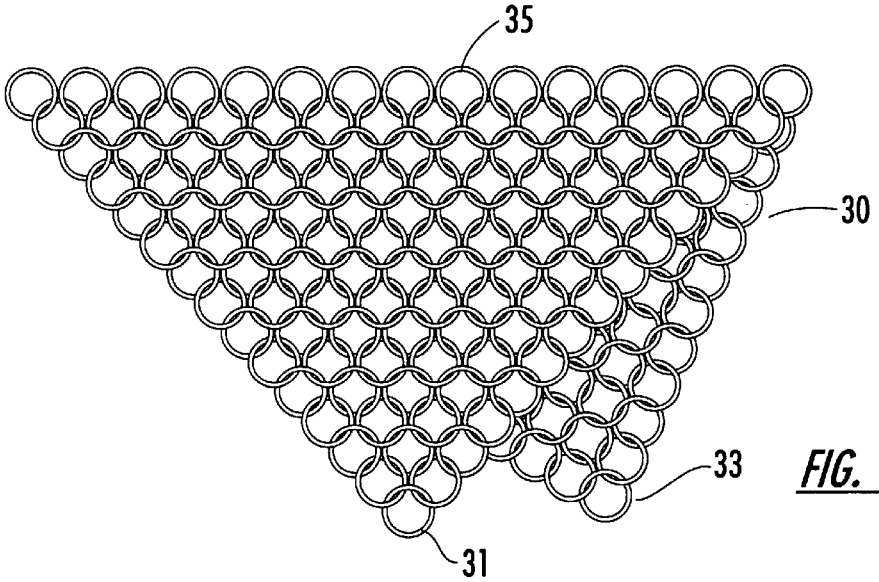
FIG. 4 is a schematic view of the web member shown in FIG. 3 folded in half prior to placement across the crotch region between adjacent fingers of a protective metal mesh glove in accordance with the subject invention.
Figure 5:
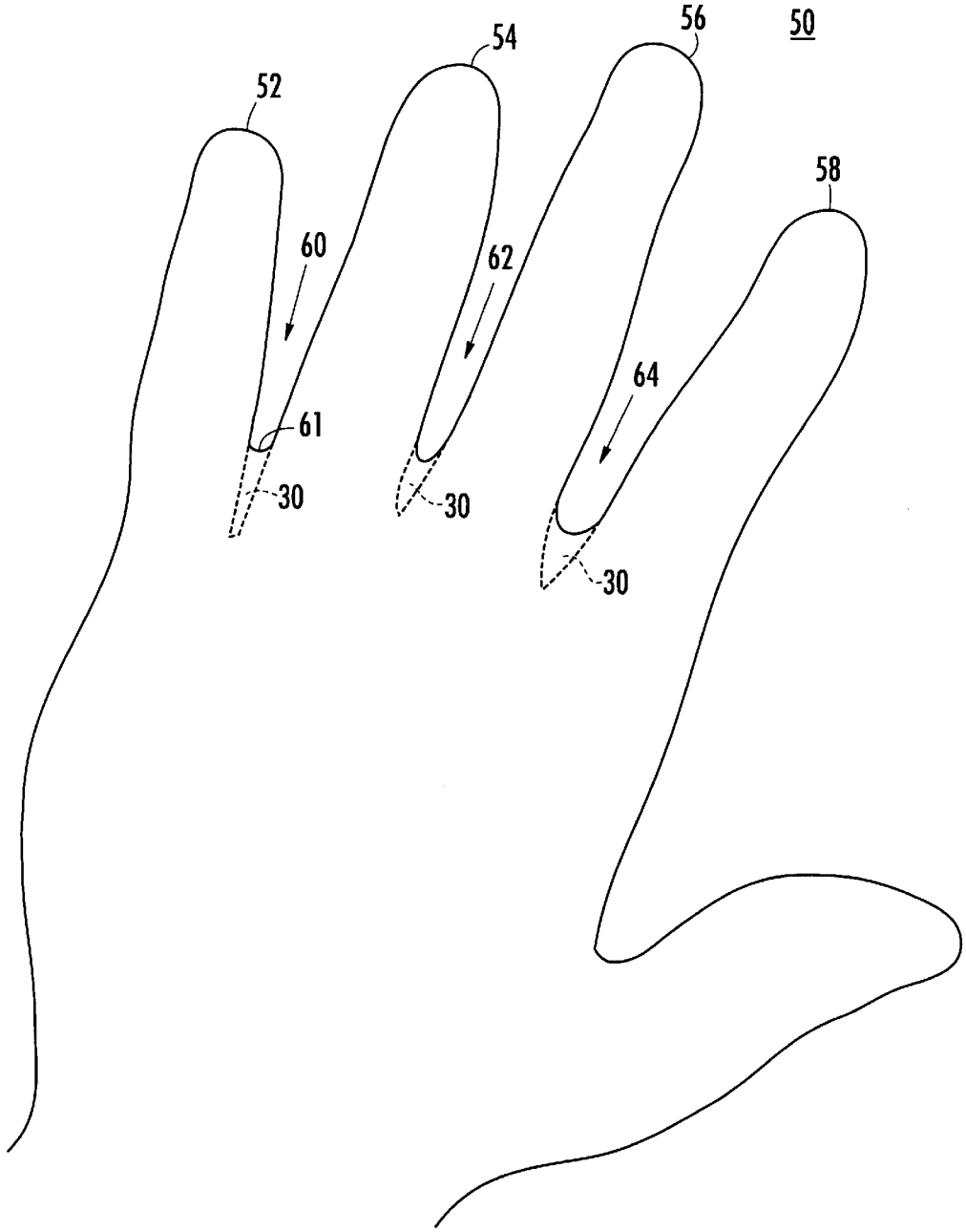
FIG. 5 is a view showing the placement of the web members across the crotch regions between the fingers of a metal mesh glove in accordance with the subject invention.

In the subject invention, a diamond shaped metal mesh web member 30, FIG. 3, is folded in half as shown in FIG. 4 and disposed across the crotch regions of metal mesh glove 50, FIG. 5 as shown. Thus end 31, FIG. 3 is folded down proximate end 33, FIG. 4 forming cradle 35.

Thus, glove 50 of this invention includes fingers 52, 54, 56, and 58 made of metal mesh material. The adjacent fingers define crotch regions 60, 62, and 64, respectively. Web members 30 are disposed across each crotch region and join adjacent fingers 52 and 54; 54 and 56; and 56 and 58 together as shown providing a cradle which more closely matches the natural U-shaped crotch region between the adjacent fingers of the human hand. This cradle formed between the adjacent fingers of the glove improves the comfort level of the glove, especially when meat hooks are used since the cradle protects the user's hand from the shank of the meat hook and also improves and increases the mean time between failures of metal mesh protective gloves. These metal mesh cradles remove a stress point associated with the V-shaped crotch regions of prior art metal mesh glove 10, FIG. 1 and therefore increase the comfort level of the glove. The addition of the cradles which more closely match the natural U-shaped crotch region between adjacent fingers of the human hand also eliminates the need for users to remove the V-shaped crotch region, a practice associated with some prior art metal mesh protective gloves.

Figure 6:
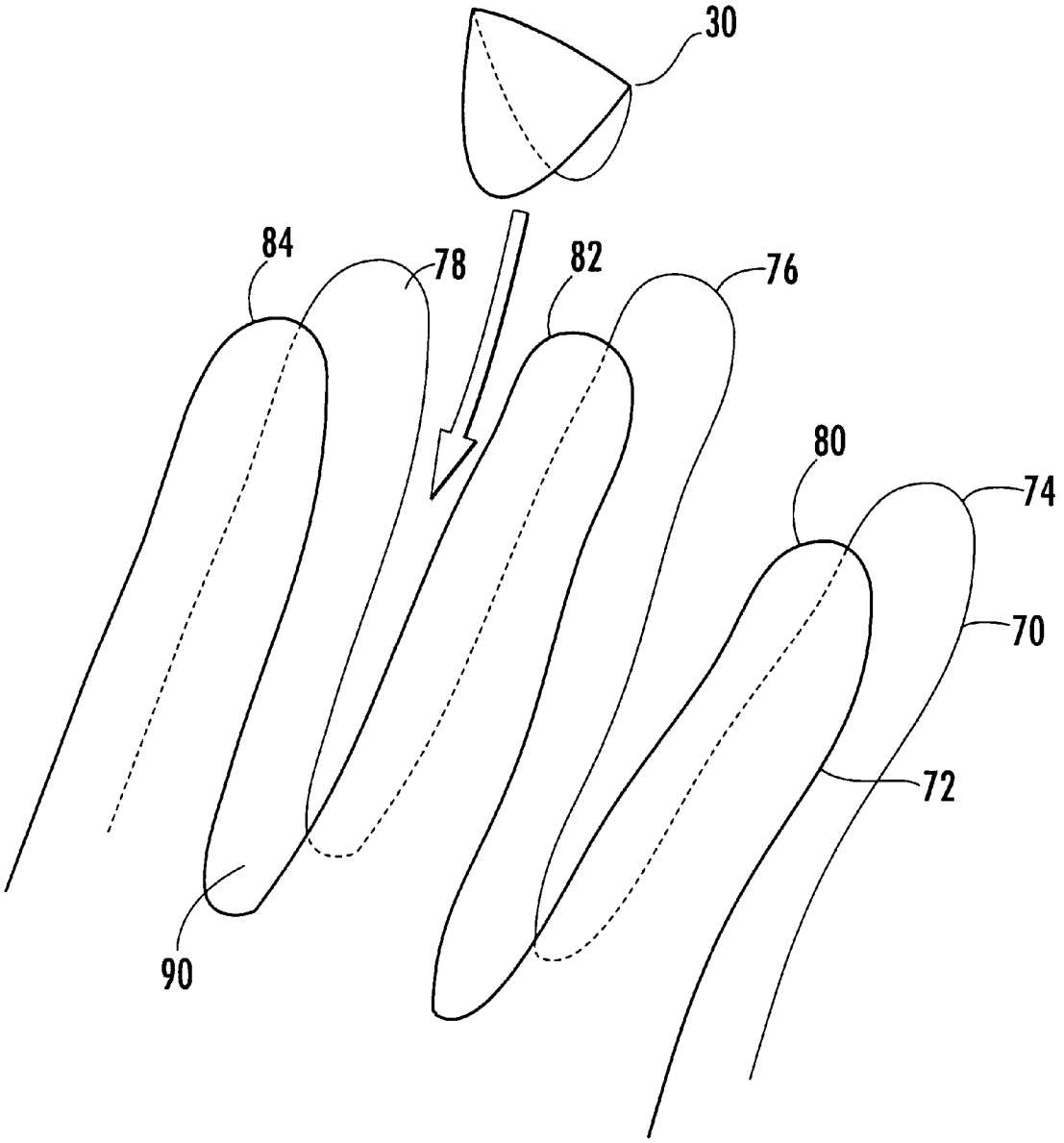
FIG. 6 is a view showing the primary steps associated with the method of manufacturing a protective glove in accordance with the subject invention.

The manufacture of glove 50, FIG. 5 is accomplished by forming two half glove sections 70, 72, FIG. 6 of metal mesh material as shown, each section including a plurality of finger portions. Accordingly, half glove section 70 includes finger portions 74, 76, and 78 and half glove section 72 includes finger portion 80, 82, and 84. These two half glove sections 70, 72 are joined together by joining the metal mesh material of each section generally at the periphery of the two sections except at the crotch regions. After a number of diamond shaped metal mesh material web members 30 are fabricated, they are folded in half and each inserted across a crotch region 90 between adjacent finger sets 76, 78 and 82, 84 and used to join two adjacent fingers together by linking the web members to the crotch regions between adjacent fingers. As shown in FIG. 5, the folded in half web member results in one side 61 of its now triangular shape extending across crotch region 60 forming a cradle which more closely matches the U-shape crotch regions of the human hand.

This method, and the resultant improved protective metal mesh glove 50, FIG. 5, eliminates the discomfort, stress points, and the practice of users of either wearing a cotton glove and/or removing the V-shaped crotch regions, practices associated with the prior art. The metal mesh "cradles" sewn between adjacent fingers improve the comfort level of the glove, especially when meat hooks are used since these cradles protect the user's hand from the shank of the meat hook. The cradles also increase the wearable life of the glove. In general, the crotch region between the thumb and the index finger does not require a cradle. But, in the preferred embodiment, the user benefits from cradles between all the other fingers of the hand but in other embodiments the cradles may be placed across only two or even only one crotch region between adjacent fingers.

Although specific features of the invention are shown in some drawings and not in others, this is for convenience only as each feature may be combined with any or all of the other features in accordance with the invention.

Other embodiments will occur to those skilled in the art and are within the following claims:

What is claimed is:

1. A protective glove comprising:

a plurality of fingers made of metal mesh material, adjacent fingers defining a crotch region therebetween; and a plurality of web members each disposed across a crotch region joining adjacent fingers together providing a U-shaped cradle for improved comfort, stress relief, and wear.

2. The protective glove of claim 1 in which the plurality of web members are made of metal mesh material.

3. The protective glove of claim 1 in which there are four fingers and three web members, one web member disposed between each pair of adjacent fingers.

4. The protective glove of claim 1 in which the web members are diamond shaped and folded over at the crotch region.

5. A method of manufacturing a protective glove, the method comprising:

forming two half glove sections of metal mesh material, each section including a plurality of finger portions, adjacent finger portions defining a crotch region therebetween;

securing the two half glove sections together by joining the metal mesh material together at the periphery of the two sections at all but the crotch regions;

fabricating metal mesh material web members; and inserting a web member across each crotch region and joining adjacent fingers together by linking each web member to each crotch region between adjacent fingers.

6. The method of claim 5 in which the fabricating step includes making a diamond shaped metal mesh material web member.

7. The method of claim 6 in which the inserting step includes folding the diamond shaped metal mesh material web member in half to form a triangle, one side of which extends across a crotch region.

8. A protective glove comprising:

a plurality of fingers made of metal mesh material, adjacent fingers defining a crotch region therebetween; and at least one web member disposed across one of said crotch regions joining two adjacent fingers together providing a U-shaped cradle for improved comfort, stress relief and wear.

9. The protective glove of claim 8 in which there is a web member disposed across a crotch region between an index finger and a middle finger providing a cradle for the shank of a meat hook.

10. A protective glove comprising:

a plurality of fingers made of metal mesh material, adjacent fingers defining a crotch region therebetween; and a plurality of web members each disposed across a crotch region joining adjacent fingers together providing a U-shaped cradle for improved comfort, stress relief, and wear, wherein the web members are diamond shaped and folded over at the crotch region.

11. A method of manufacturing a protective glove, the method comprising:

forming two half glove sections of metal mesh material, each section including a plurality of finger portions, adjacent finger portions defining a crotch region therebetween;

securing the two half glove sections together by joining the metal mesh material together at the periphery of the two sections at all but the crotch region;

fabricating metal mesh material web members by making a diamond shaped metal mesh material web member; and inserting a web member across each crotch region and joining adjacent fingers together by linking each web to each crotch region between adjacent fingers.

12. A protective glove comprising:

a plurality of fingers made of metal mesh material, adjacent fingers defining a crotch region therebetween; and at least one diamond shaped web member folded over one said crotch region joining two adjacent fingers together providing a U-shaped cradle for improved comfort, stress relief, and wear.

13. A protective glove of claim 12 in which there is a web member disposed across a crotch region between and index finger and a middle finger providing a cradle for the shank of a meat hook.

14. A protective glove comprising:

a plurality of fingers made of metal mesh material, adjacent fingers defining a crotch region therebetween; and a plurality of metal mesh material web members each disposed across a crotch region joining adjacent fingers together providing a U-shaped cradle for improved comfort, stress relief, and wear.

15. A protective metal mesh glove comprising:

a plurality of fingers made solely of metal mesh material, adjacent fingers defining crotch regions therebetween; and a plurality of web members made solely of metal mesh material disposed across the crotch regions and linked to the metal mesh material of the fingers of the glove thereby adjoining adjacent fingers together providing a U-shaped cradle for improved comfort, stress relief, and wear.

16. The protective metal mesh glove of claim 15 in which the metal mesh material web members are diamond shaped and folded over having one portion joined to a front of the glove and one portion joined to the back of a glove between the adjacent fingers.

* * * * *